US011970301B2

(12) United States Patent
Zhou

(10) Patent No.: US 11,970,301 B2
(45) Date of Patent: Apr. 30, 2024

(54) SYSTEM FOR PACKAGING FIREWORKS WITH LAUNCHING TUBES

(71) Applicant: Hongbo Zhou, Liuyang (CN)

(72) Inventor: Hongbo Zhou, Liuyang (CN)

( * ) Notice: Subject to any disclaimer, the term of this patent is extended or adjusted under 35 U.S.C. 154(b) by 339 days.

(21) Appl. No.: 17/475,613

(22) Filed: Sep. 15, 2021

(65) Prior Publication Data

US 2022/0081137 A1 Mar. 17, 2022

Related U.S. Application Data

(60) Provisional application No. 63/078,902, filed on Sep. 16, 2020.

(51) Int. Cl.

| | |
|---|---|
| ***B65B 5/10*** | (2006.01) |
| ***B65B 5/08*** | (2006.01) |
| ***B65B 23/00*** | (2006.01) |
| ***F42B 4/22*** | (2006.01) |

(52) U.S. Cl.

CPC ..... *B65B 5/10* (2013.01); *B65B 5/08* (2013.01); *B65B 23/00* (2013.01); *F42B 4/22* (2013.01)

(58) Field of Classification Search

CPC . F42B 4/22; B65B 23/00; B65B 23/08; B65B 23/10

USPC ..... 102/361

See application file for complete search history.

(56) References Cited

U.S. PATENT DOCUMENTS

| | | | | |
|---|---|---|---|---|
| 1,812,311 | A * | 6/1931 | Wolf | B65D 5/106 206/584 |
| 2,053,454 | A | 9/1936 | Banning | |
| 3,227,084 | A * | 1/1966 | Stokes | F42B 4/22 102/357 |
| 5,979,329 | A | 11/1999 | Collar | |
| 6,457,415 | B1 | 10/2002 | Yan | |
| 6,851,371 | B1 | 2/2005 | Wah | |
| 7,011,220 | B2 * | 3/2006 | Deye | F42B 4/20 211/60.1 |
| 7,086,530 | B2 | 8/2006 | Price et al. | |
| 7,681,502 | B2 * | 3/2010 | Huang | F42B 4/14 102/358 |
| 8,286,556 | B2 | 10/2012 | Zhong et al. | |
| 8,322,285 | B2 | 12/2012 | Zhong et al. | |
| 10,393,483 | B2 | 8/2019 | Lu | |
| 11,692,799 | B1 * | 7/2023 | Tasick | F42B 4/24 102/335 |
| 2015/0300790 | A1 | 10/2015 | Huang et al. | |
| 2018/0106580 | A1 * | 4/2018 | Li | F42B 4/20 |
| 2021/0003375 | A1 * | 1/2021 | Du | F42B 39/24 |

* cited by examiner

*Primary Examiner* — John Cooper

(74) *Attorney, Agent, or Firm* — Olav M. Underdal; IDP Patent Services

(57) ABSTRACT

A firework packaging system includes a firework packaging assembly, including a first and second firework assemblies, each including a base unit and a plurality of launching tubes mounted in the base unit, such that the first firework assembly and the second firework assembly are packaged in an opposing overlapping configuration, with internal overlap such that first tubes slide into second tubes, or external overlap such that first tubes slide between adjacent second tubes. The fireworks packaging system can further include a shipping crate, containing a plurality of cases, each containing a plurality of firework packaging assemblies.

27 Claims, 18 Drawing Sheets

Firework Packaging Assembly

Firework Packaging Assembly

Firework Packaging System

Firework Packaging System

Fireworks Packaging Assembly

Fireworks Packaging System

Fireworks Packaging System

SYSTEM FOR PACKAGING FIREWORKS WITH LAUNCHING TUBES

CROSS-REFERENCE TO RELATED APPLICATIONS

This application claims the benefit of U.S. Provisional Application No. 63/078,902, filed Sep. 16, 2020; which is hereby incorporated herein by reference in its entirety.

FIELD OF THE INVENTION

The present invention relates generally to the field of fireworks packaging and shipping, and more particularly to methods and systems for safe and space efficient packaging of fireworks with launching tubes.

BACKGROUND OF THE INVENTION

Ariel fireworks typically require launching tubes to propel the fireworks into the air in order to produce the desired effects. Ariel fireworks can be produced and packaged with or without launching tubes. This invention is concerned with the packaging method for fireworks which are produced and packaged with a launching tube or tubes.

Fireworks produced and packaged with launching tube typically contain two main parts: the fireworks working part and the launching part. The fireworks working part mainly consists of a lift charge and an effect charge. The fireworks' working part is typically a ball or a cylinder shape that fits into the launching tubes. One side of the launching tube is sealed off, which is typically referred to as the base, and the open side points in the direction where the fireworks will be projected. While the fireworks are in a working state, the lift charge is ignited first and propel the effect charge into the sky by reacting the explosive gas with the launching tube, whereupon the effect charge is ignited to produce the desired display. This type of fireworks device is commonly referred as single shot or multi shot aerial fireworks, depending on the number of launching tubes in the device.

Shipping costs of fireworks are mostly determined by the volume of the shipment; therefore it is beneficial to package fireworks in a more compact way. Typically, such fireworks devices are packaged without the launching tube of one device overlapping the other device. The present invention provides an innovative way to package and ship the fireworks to save shipping costs. This packaging method also improves safety measures since the launching tubes will not have open ends in the final package, which can better contain fireworks charges in case of an accident during shipping.

As such, considering the foregoing, it may be appreciated that there continues to be a need for novel and improved devices and methods for safe and space efficient packaging of fireworks with launching tubes.

SUMMARY OF THE INVENTION

The foregoing needs are met, to a great extent, by the present invention, wherein in aspects of this invention, enhancements are provided to the existing model of packaging of fireworks with launching tubes.

In an aspect, a firework packaging assembly can include:

a) a first firework assembly, which can include:
  i. a first base unit, which can include
    1) a first base body;
    2) a first base bottom board, which is mounted on a bottom of the first base body;
    3) a first base header board, which is mounted on a top of the first base body; and
  ii. a plurality of first launching tubes, wherein each first launching tube can include:
    1) a first tube body; and
    2) a first firework shell, which is mounted in a bottom of the first tube body, wherein the firework shell can include:
      a first lift charge; and
      a first effect charge, which is positioned on an outer side of the first lift charge;
      such that the first lift charge is configured to expel the first effect charge from the first launching tube, when the lift charge is ignited;
    wherein each first launching tube is mounted in the first base unit; and
b) a second firework assembly, which can include:
  i. a second base unit, which can include
    1) a second base body;
    2) a second base bottom board, which is mounted on a bottom of the second base body;
    3) a second base header board, which is mounted on a top of the second base body; and
  ii. a plurality of second launching tubes, wherein each second launching tube can include:
    1) a second tube body; and
    2) a second firework shell, which is mounted in a bottom of the first tube body, wherein the second firework shell can include:
      a second lift charge; and
      a second effect charge, which is positioned on an outer side of the second lift charge;
      such that the second lift charge is configured to expel the second effect charge from the second tube body, when the second lift charge is ignited;
    wherein each second launching tube is mounted in the second base unit;
wherein the first firework assembly and the second firework assembly can be configured to be packaged in an opposing overlapping configuration.

In a related aspect, the opposing overlapping configuration can be an opposing internally overlapping configuration, such that each corresponding first tube body of the first firework assembly is configured to be insertable into a corresponding second tube body of the second firework assembly.

In another related aspect, the opposing overlapping configuration can be an opposing externally overlapping configuration, such that each corresponding first tube body of the first firework assembly is configured to be insertable into a corresponding opening between adjacent second tube bodies of the second firework assembly.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
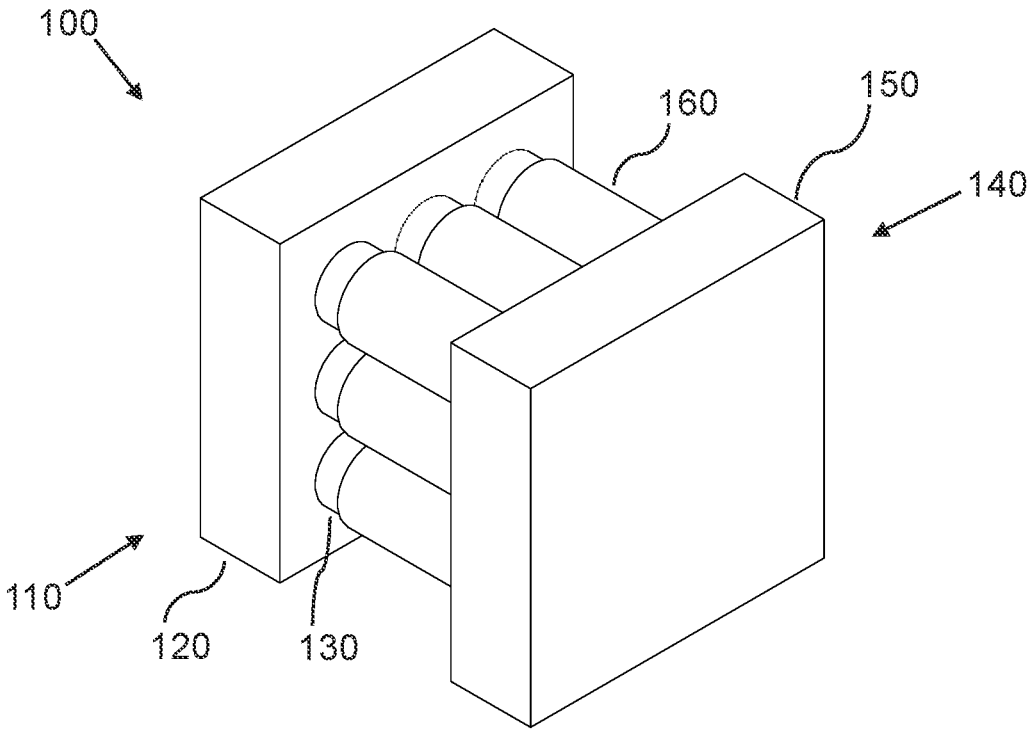
FIG. 1A is a perspective view of a firework packaging assembly of a firework packaging system, shown in an assembled configuration, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a firework packaging assembly 100 with reference to FIG. 1A, in such manner that like reference numerals refer to like components throughout; a convention that we shall employ for the remainder of this specification.

In various embodiments, a firework packaging assembly 100 for packaging fireworks products with a launching tube is disclosed herein. The firework packaging assembly 100 can include a pair of first and second firework assemblies 110, 140, wherein each first launching tube 130 of the first firework assembly 110 can be inserted (i.e., slide into) into a corresponding launching tube of the second firework assembly 140. The launching tubes 130, 160 of the first and second firework assemblies 110, 140 are opposedly oriented, such that narrower first launching tubes 130 are configured to slide into corresponding openings of wider second launching tubes 160. A fireworks shell 134, 164, which includes a lift charge 136, 166 and an effect charge 138, 168, is positioned in a bottom portion of each launching tube 130, 160.

In related embodiments, the firework packaging assembly 100 can reduce fireworks shipping volume and improve safety by overlapping the launching tubes 130, 160, when the system is a completely packaged configuration. The overlapping can be via an internal overlap of launching tubes 130, 160, as shown in FIGS. 1A-1E and 2A-2B, or via an interlacing side-by-side external overlap of launching tubes 530, 560, as shown in FIGS. 5A-5E and 6A-6B.

Thus, in various related embodiments, the first and second firework assemblies 110, 140 (which can also be referred to a "cakes" 110, 140, in accordance with colloquial trade parlance), which includes multiple launching tubes that share a common base. Each tube 130, 160 includes of an aerial fireworks unit, which will be projected into the sky, exploding and producing the desired effects. The tubes 130, 160 can typically be placed safely distanced from each other when lit. Per fireworks safety regulations, the cakes 110, 140 have to be shipped with an outer container, typically referred as the "case", made from cardboard. A case can contain a single cake 110, 140 or multiple cakes 110, 140. For cases with multiple cakes, the current practice is to place the cakes 110, 140 in the same orientation with the base on the bottom.

In related embodiment, the firework packaging assembly 100 provides new ways to package fireworks, by overlapping the launching tubes either externally or internally. Within each pair of fireworks, one set of fireworks is orientated 180 degrees from its peer with its base point outward and the launching tube exit end pointing toward the other fireworks unit. Internally means that one launching tube is smaller than the other launching tube and that the smaller tube is inserted inside the large launching tube in the final package, as shown in FIGS. 1A-1E and 2A-2B. The external overlapping method refers to the method in which a fireworks launching unit is inserted into the space between the tubes of the other unit, as shown in FIGS. 5A-5E and 6A-6B.

In an embodiment, as shown in FIGS. 1A-1E and 2A-2B, a firework packaging assembly 100 can include:

a) a first firework assembly 110, which can include:
  i. a first base unit 120, which can include:
    1) a first base body 122;
    2) a first base bottom board 124, which is mounted on a bottom of the first base body 122; and
    3) a first base header board 126, which is mounted on a top of the first base body 122; and
  ii. at least one first launching tube 130, or a plurality of first launching tubes 130, wherein each first launching tube 130 can include:
    1) a first tube body 132; and
    2) a first combustion member 131, which can be configured as a first firework shell 134, which is mounted in a bottom of the first tube body 132, wherein the first firework shell 134 can include:
      a first lift charge 136; and
      a first effect charge 138, which is positioned on an outer side of the first lift charge 136, toward the opening of the first tube body 132;
      such that the first lift charge 136 is configured to expel the first effect charge 138 from the first launching tube, when the lift charge 136 is ignited;
  wherein an inner portion of each first launching tube 130 is mounted in the first base unit 120; and b) a second firework assembly 140, which can include:
  i. a second base unit 150, which can include
    1) a second base body 152;
    2) a second base bottom board 154, which is mounted on a bottom of the second base body 152; and
    3) a second base header board 156, which is mounted on a top of the second base body 152; and
  ii. at least one second launching tube 160, or a plurality of second launching tubes 160, wherein each second launching tube 160 can include:
    1) a second tube body 162; and
    2) a second combustion member 161, which can be configured as a second firework shell 164, which is mounted in a bottom of the second tube body 162, wherein the second firework shell 164 can include:
      a second lift charge 166; and
      a second effect charge 168, which is positioned on an outer side of the second lift charge 166, toward the opening of the second tube body 162;
      such that the second lift charge 166 is configured to expel the second effect charge 168 from the second tube body 162, when the second lift charge 166 is ignited;
  wherein an inner portion of each second launching tube 160 is mounted in the second base unit 150;

wherein the first firework assembly 110 and the second firework assembly 140 can be configured to be packaged in an opposing overlapping configuration, which can be an opposing internally overlapping configuration;

whereby the firework packaging assembly 100 can be conveniently packaged for transport and storage, with first and second firework assemblies 110, 140 tightly packed.

In a related embodiment, as shown in FIGS. 1A-1E and 2A-2B, an outer portion of each corresponding first tube body 132 of the first firework assembly 110 can be configured to be insertable (i.e., slide into) into a corresponding second tube body 162 of the second firework assembly 140, wherein an outer diameter 133 of the outer portion of the corresponding first tube body 132 is configured to match an inner diameter 163 of the corresponding second tube body 162, i.e. such that the outer diameter 133 of the outer portion of the corresponding first tube body 132 is slightly smaller than the inner diameter 163 of the corresponding second tube body 162;

such that the first firework assembly 110 and the second firework assembly 140 can be configured to be packaged in an opposing internally overlapping configuration, wherein an outer portion of each corresponding first tube body 132 is inserted into the corresponding second tube body 162, i.e., such that the first firework assembly 110 and the second firework assembly 140 are opposing/oppositely/opposedly assembled, such that respective first and second base units 120, 150 are on outer sides with respective first and second launching tubes 130, 160 pointing toward each other.

Figure 2A:
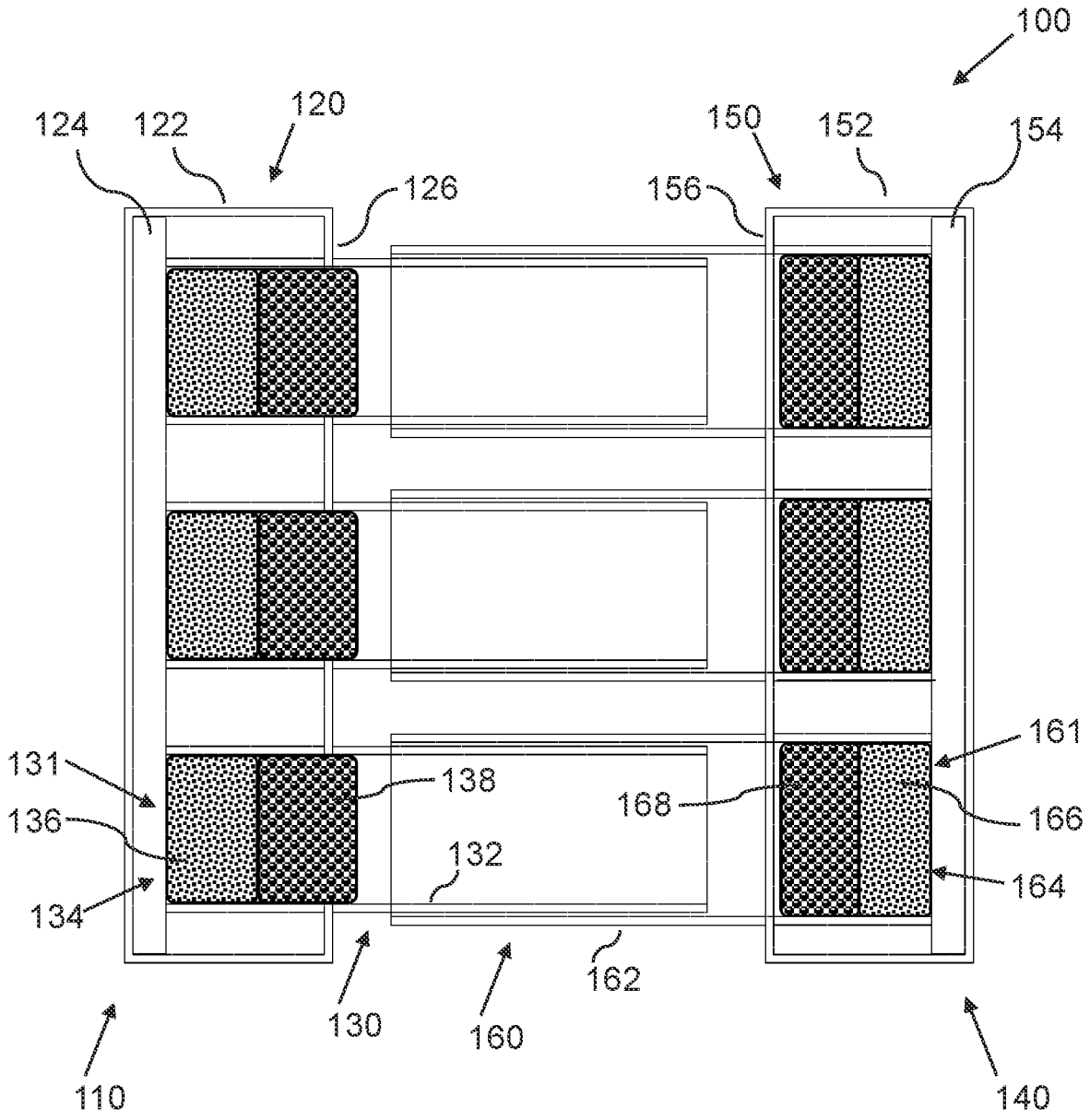
FIG. 2A is a cross-sectional view of the firework packaging assembly, taken along section line 2A-2A of FIG. 1B, according to an embodiment of the invention.
Figure 2B:
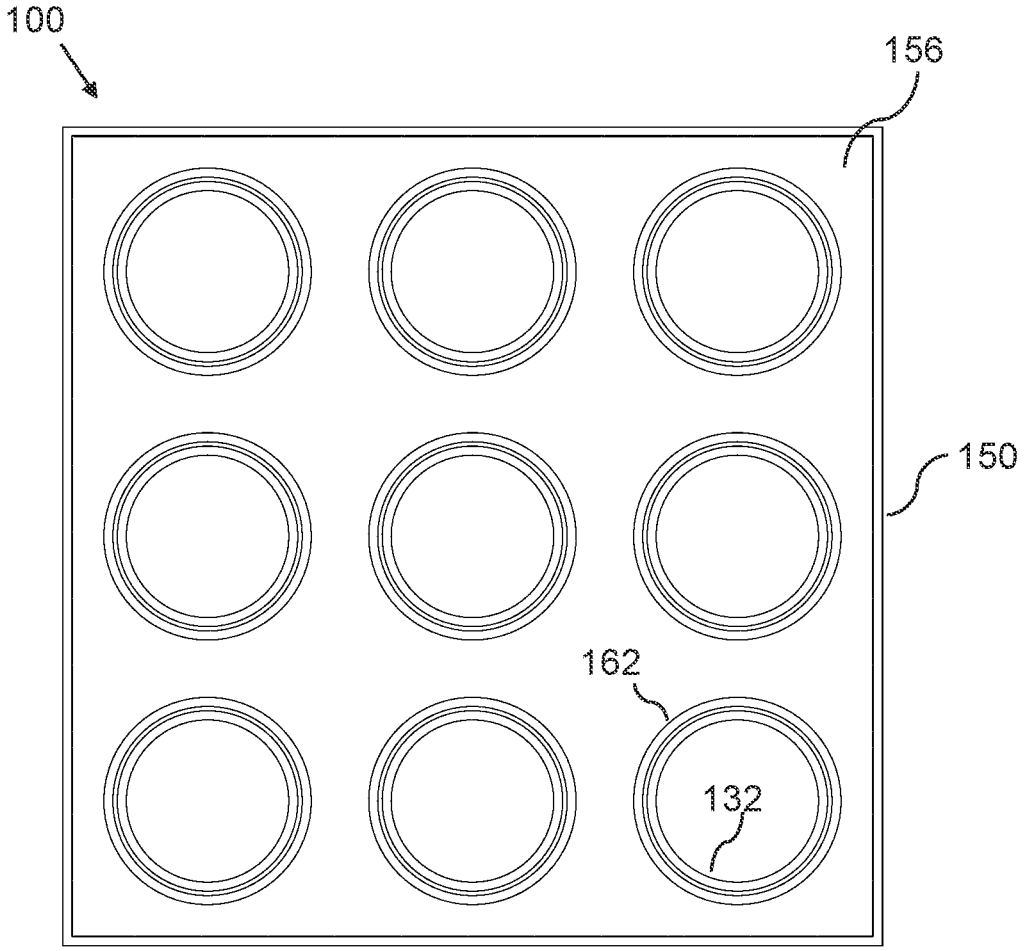
FIG. 2B is a cross-sectional view of the firework packaging assembly, taken along section line 2B-2B of FIG. 1B, according to an embodiment of the invention.
Figure 2C:
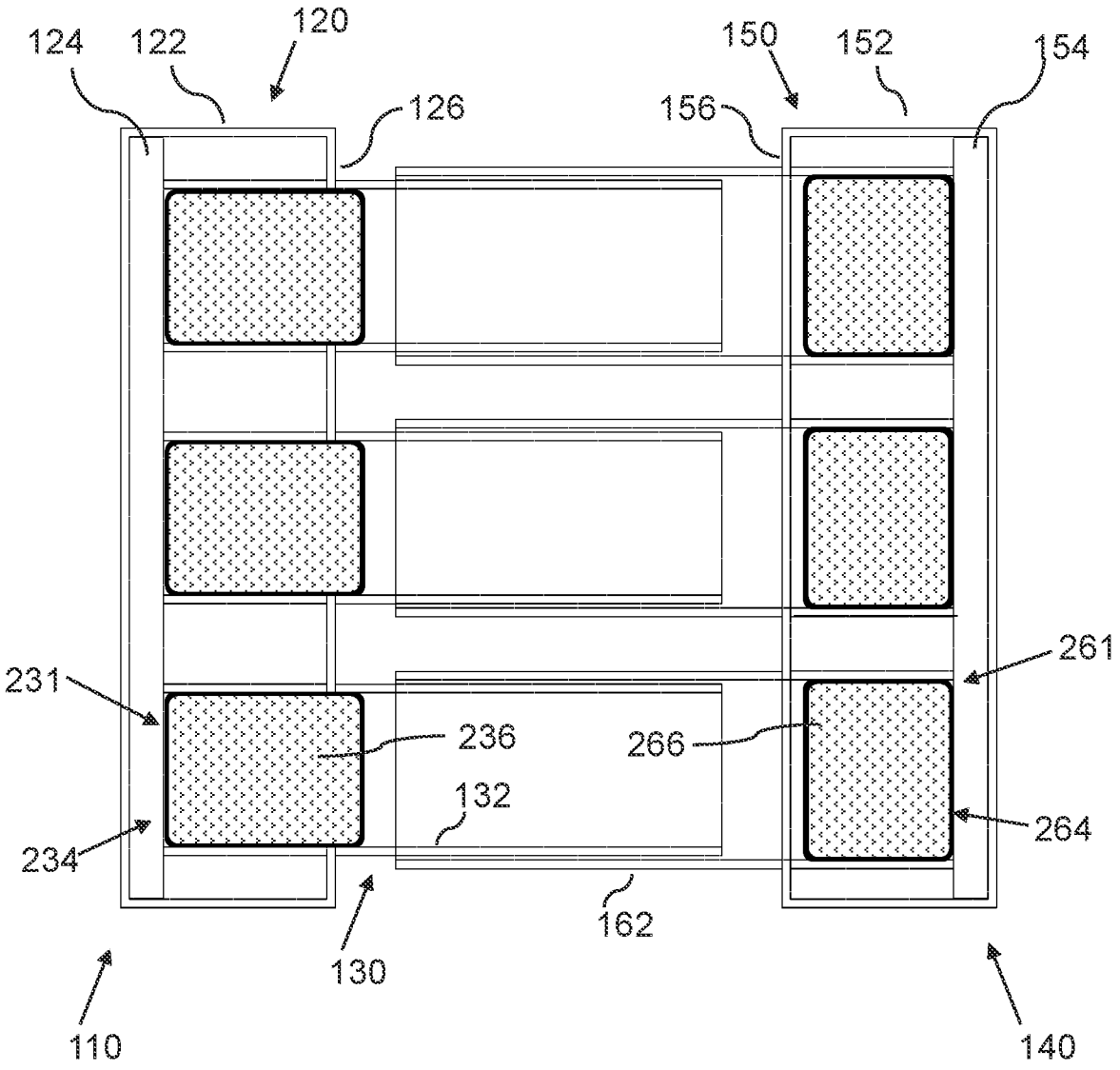
FIG. 2C is a cross-sectional view of the firework packaging assembly, taken along section line 2A-2A of FIG. 1B, according to an embodiment of the invention.

In a related embodiment, as shown in FIG. 2C:

a) the first combustion member 231 can be configured as a first firework mine 234, which is mounted in a bottom of the first tube body 132, wherein the first firework mine 234 can include a composition 236 of a first lift charge and a first effect charge;
  such that the first lift charge is configured to expel first firework mine 234 from the first launching tube, when the first firework mine 234 is ignited; and b) the second combustion member 261 can be configured as a second firework mine 264, which is mounted in a bottom of the second tube body 162, wherein the second firework mine 264 can include a composition 266 of a second lift charge and a second effect charge; such that the second lift charge is configured to expel the second firework mine 264 from the second launching tube, when the second firework mine 264 is ignited.

In a further related embodiment, each of the first firework assembly 110 and the second firework assembly 140 can be configured with one launching tube 130, 160; 2-8 launching tubes 130, 160; or nine launching tubes 130, 160, which can be arranged in three rows and three columns; or with a large plurality of launching tubes 130, 160, such as 100 or more launching tubes 130, 160.

Figure 1B:
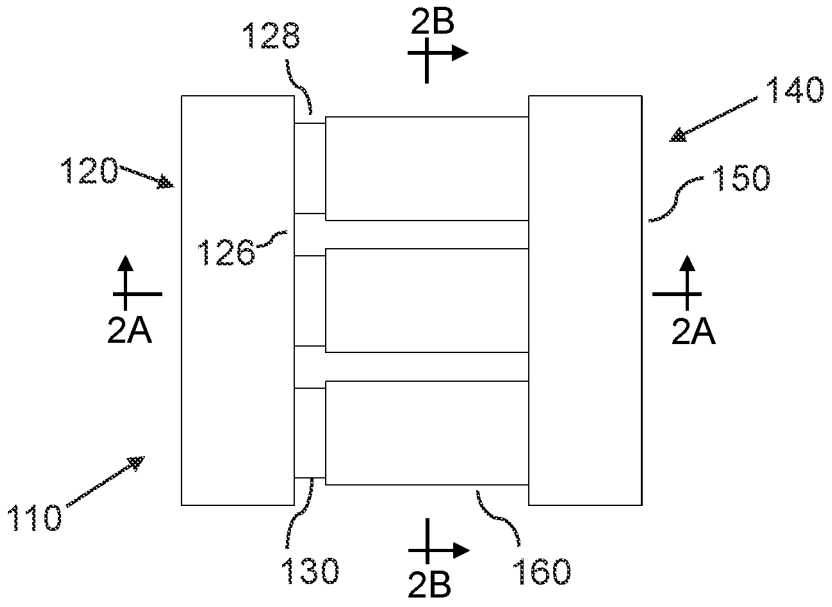
FIG. 1B is a top view of a firework packaging assembly of a firework packaging system, according to an embodiment of the invention.
Figure 1C:
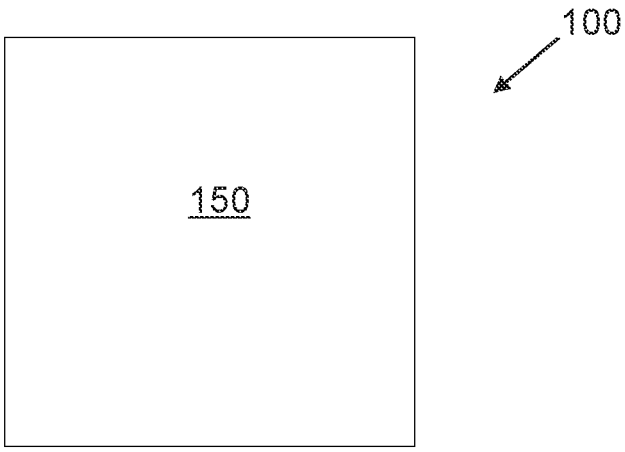
FIG. 1C is a right side view of a firework packaging assembly of a firework packaging system, according to an embodiment of the invention.
Figure 1D:
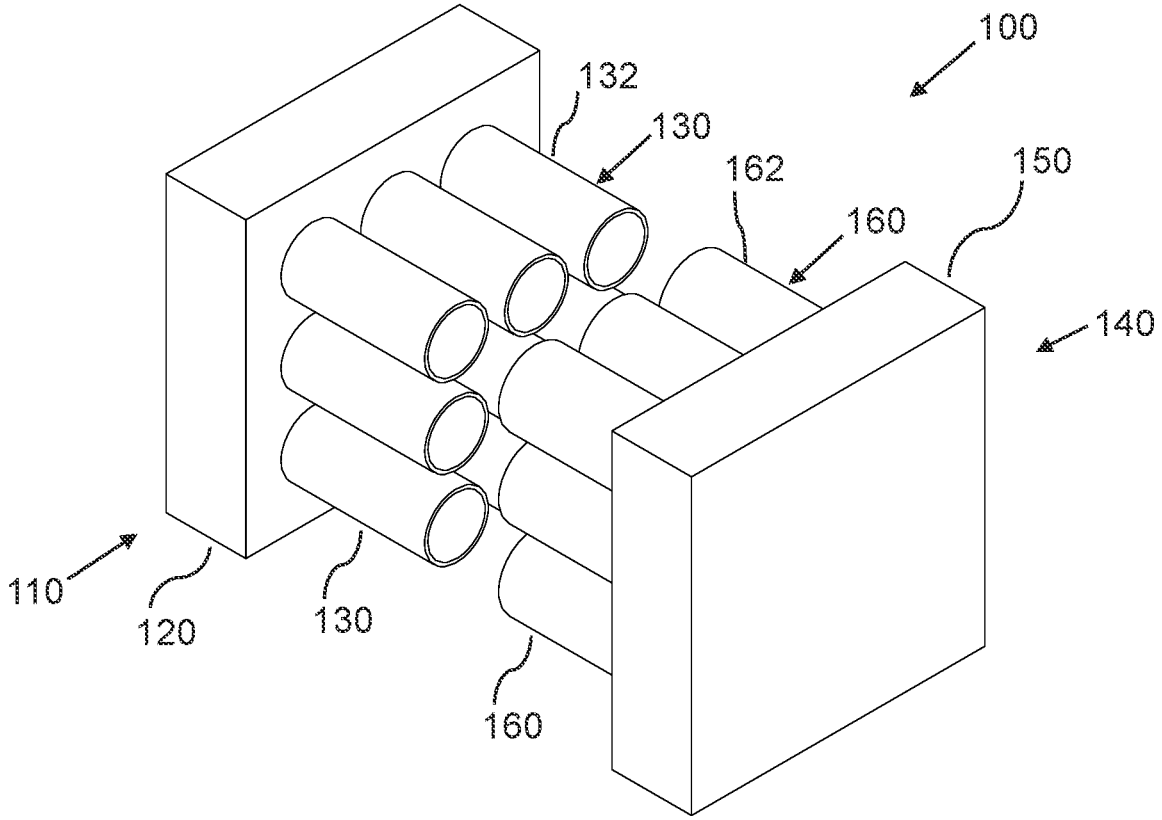
FIG. 1D is a perspective view of a firework packaging assembly of a firework packaging system, shown in a disassembled configuration, according to an embodiment of the invention.
Figure 1E:
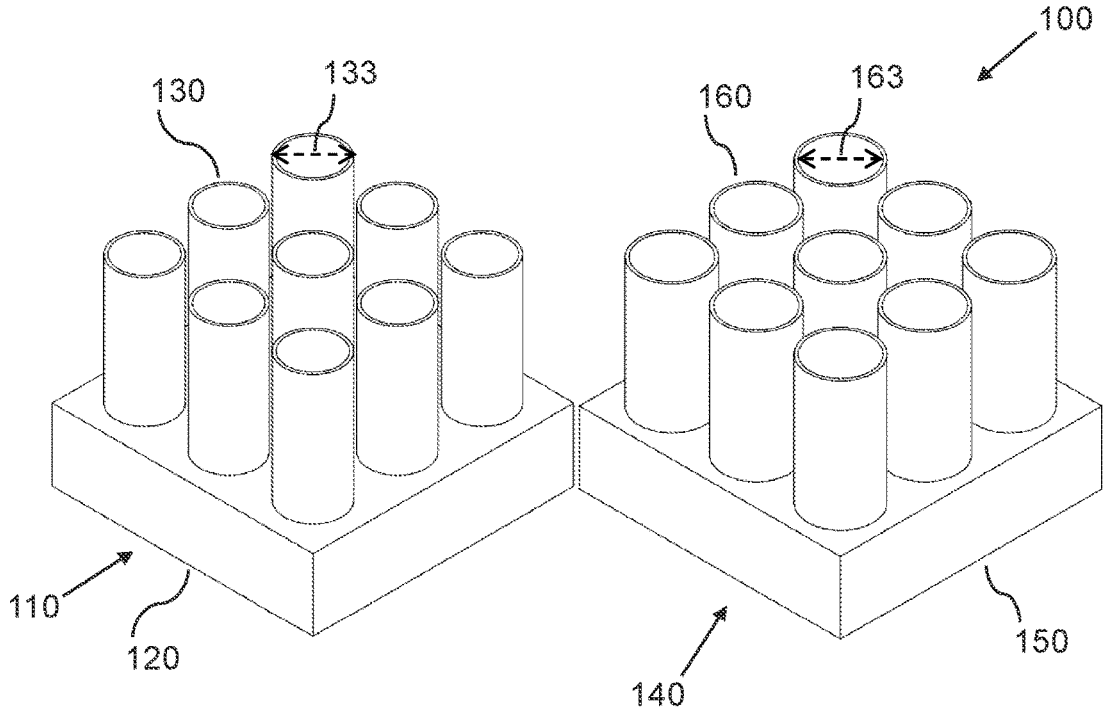
FIG. 1E is a perspective view of a firework packaging assembly of a firework packaging system, shown in a disassembled configuration, according to an embodiment of the invention.
Figure 1F:
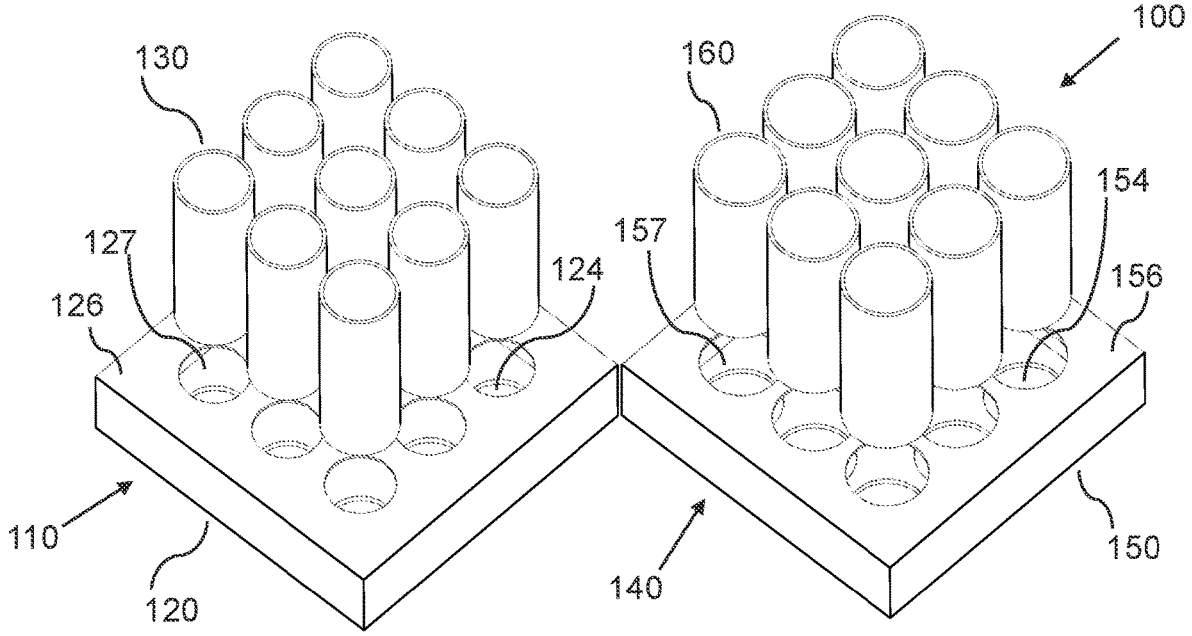
FIG. 1F is a perspective view of a firework packaging assembly of a firework packaging system, shown in a disassembled configuration with launching tubes detached, according to an embodiment of the invention.

In another related embodiment, as shown in FIG. 1F, upper surfaces of the first base unit 120 and the second base unit 150, can each include receiving apertures 127, 157, which protrude the base header board 126, 156, such that the base bottom board 124, 154 form a bottom of each receiving aperture 127, 157, such that the launching tubes 130, 160 are detachably positionable in the receiving apertures 127, 157.

Figure 1G:
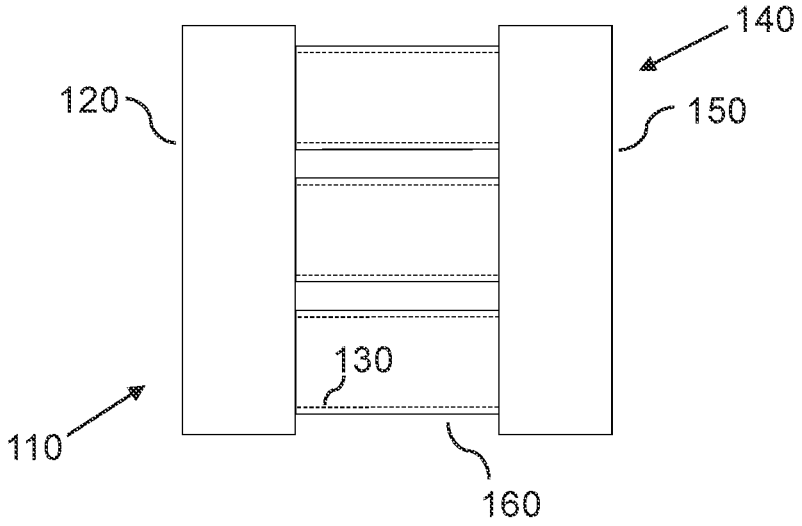
FIG. 1G is a top view of a firework packaging assembly of a firework packaging system, according to an embodiment of the invention.

In related embodiments, as shown in FIGS. 1B and 1G, the firework packaging assembly 100 can be configured with a variable gap 128 between outer ends of second launching tubes 160 and the base header board 126 of the first base unit 120, depending on how far first launching tubes 130 are slid into corresponding second launching tubes 160. FIG. 1G shows a configuration wherein the first launching tubes 130 are maximally inserted, such that outer ends of second launching tubes 160 touch or almost touch the base header board 126, such that the variable gap 128 is substantially zero.

Figure 3:
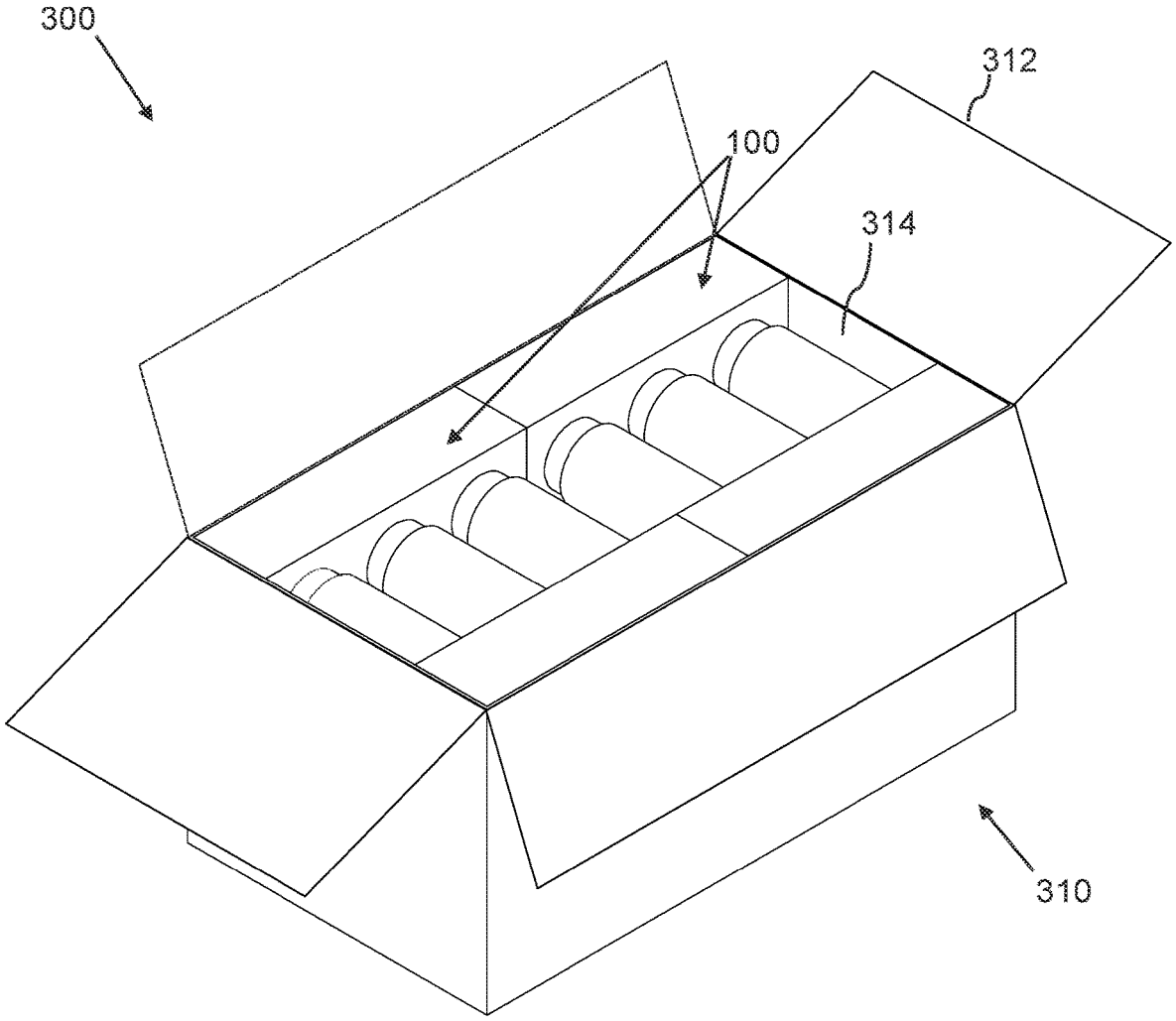
FIG. 3 is a perspective view of a firework packaging system, including two packaged firework packaging assemblies, according to an embodiment of the invention.

In a related embodiment, as shown in FIG. 3, a firework packaging system 300 can include:

a) a firework case 310, which can include:
   i. a packaging case 312, which includes a packaging interior 314; and
   ii. A plurality of firework packaging assemblies 100, which are positioned in the packaging interior 314 of the packaging case 312, wherein the plurality of firework packaging assemblies 100 comprises the firework packaging assembly 100.

In a further related embodiment, as shown in FIG. 3, the firework case 310 can include two firework packaging assemblies 100.

Figure 4:
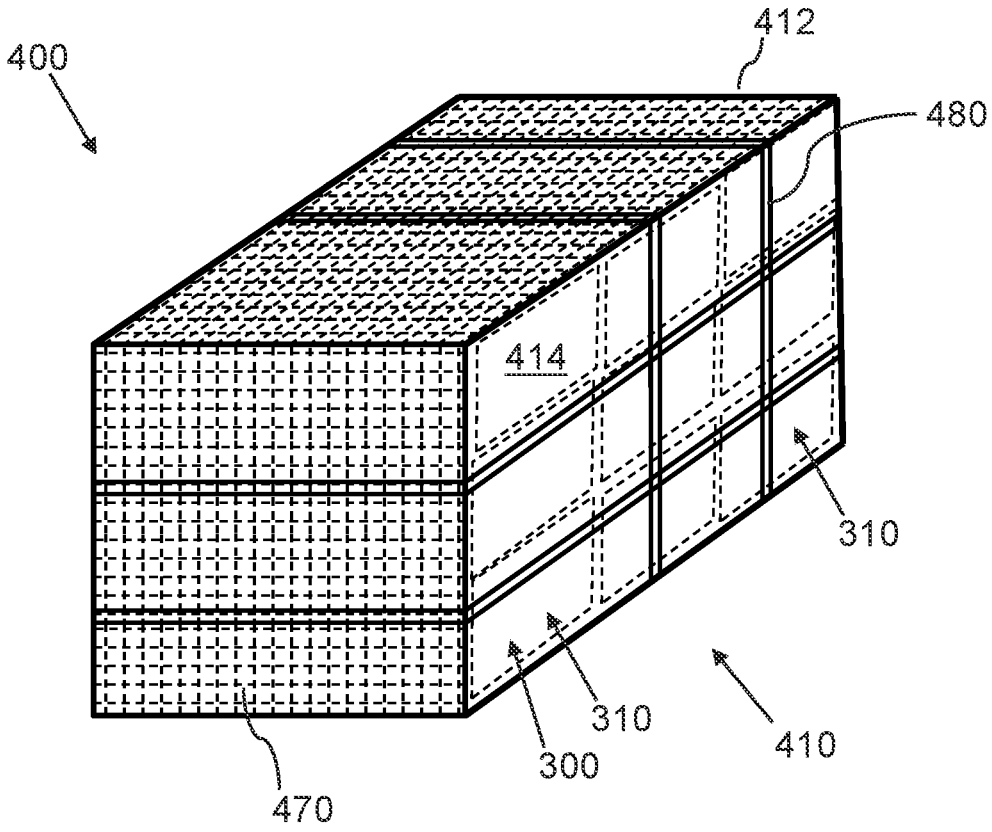
FIG. 4 is a perspective view of a firework packaging system, according to an embodiment of the invention.

In a related embodiment, as shown in FIG. 4, a firework packaging system 400 can include:

a) a firework crate 410, which can include:
   i. a shipping crate 412, which includes a crate interior 414; and
   ii. a plurality of firework cases 310 (with firework packaging assemblies 100 inside), which are positioned in the crate interior 414 of the shipping crate 412, wherein the plurality of firework cases 310 comprises the firework case 310.

In a further related embodiment, as shown in FIG. 4, the firework packaging system 400, can further include:

a) a protective mesh 470, which can be made of metal, wherein the protective mesh 470 can be positioned on an outer surface of the shipping crate 412 such as for example on front, rear, top, and bottom of the shipping crate 412, or on all sides of the shipping crate 412; and
b) a plurality of packing bands 480, which can be metal bands 480, wherein the packing bands 480 can be tightened around (vertically or horizontally) the shipping crate 412, for example at least partially on top of the protective mesh 470.

In an embodiment, as shown in FIGS. 5A-5E and 6A-6B, a firework packaging assembly 500 can include:

a) a first firework assembly 510, which can include:
   i. a first base unit 520, which can include
      1) a first base body 522;
      2) a first base bottom board 524, which is mounted on a bottom of the first base body 522; and
      3) a first base header board 526, which is mounted on a top of the first base body 522; and
   ii. a plurality of first launching tubes 530, wherein each first launching tube 530 can include:
      1) a first tube body 532; and
      2) a first combustion member 531, which can be configured as a first firework shell 534, which is mounted in a bottom of the first tube body 532, wherein the first firework shell 534 can include:
         a first lift charge 536; and
         a first effect charge 538, which is positioned on an outer side of the first lift charge 536, toward the opening of the first tube body 532;
         such that the first lift charge 536 is configured to expel the first effect charge 538 from the first tube body 532, when the first lift charge 536 is ignited;
   wherein an inner portion of each first launching tube 530 is mounted in the first base unit 520;
b) a second firework assembly 540, which can include:
   i. a second base unit 550, which can include
      1) a second base body 552;
      2) a second base bottom board 554, which is mounted on a bottom of the base body 522;
      3) a second base header board 556, which is mounted on a top of the base body 522; and
   ii. a plurality of second launching tubes 560, wherein each second launching tube 560 can include:
      1) a second tube body 562; and
      2) a second combustion member 561, which can be configured as a second firework shell 564, which is mounted in a bottom of the second tube body 562, wherein the second firework shell 564 can include:
         a second lift charge 566; and
         a second effect charge 568, which is positioned on an outer side of the second lift charge 566, toward the opening of the second tube body 562;
         such that the second lift charge 566 is configured to expel the second effect charge 568 from the second tube body 562, when the second lift charge 566 is ignited;
   wherein an inner portion of each second launching tube 560 is mounted in the second base unit 550;

wherein the first firework assembly 510 and the second firework assembly 540 can be configured to be packaged in an opposing overlapping configuration, which can be an opposing externally overlapping configuration;

whereby the firework packaging assembly 500 can be conveniently packaged for transport and storage, with first and second firework assemblies 510, 540 tightly packed.

Figure 5A:
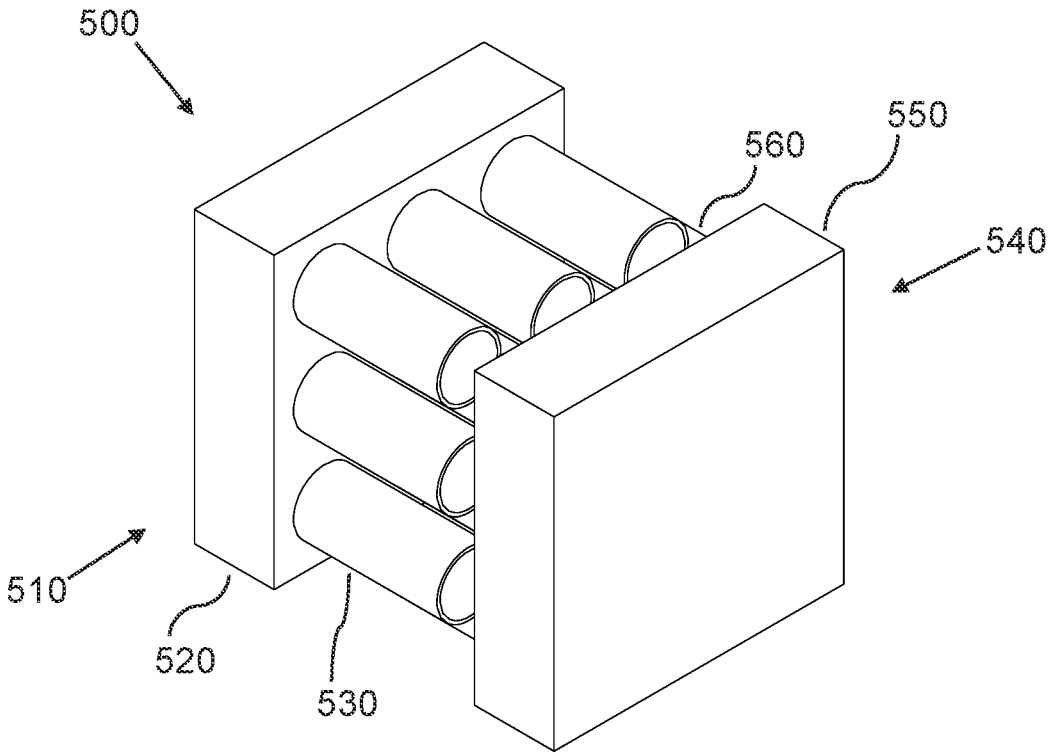
FIG. 5A is a perspective view of a firework packaging assembly of a firework packaging system, shown in an assembled configuration, according to an embodiment of the invention.
Figure 5B:
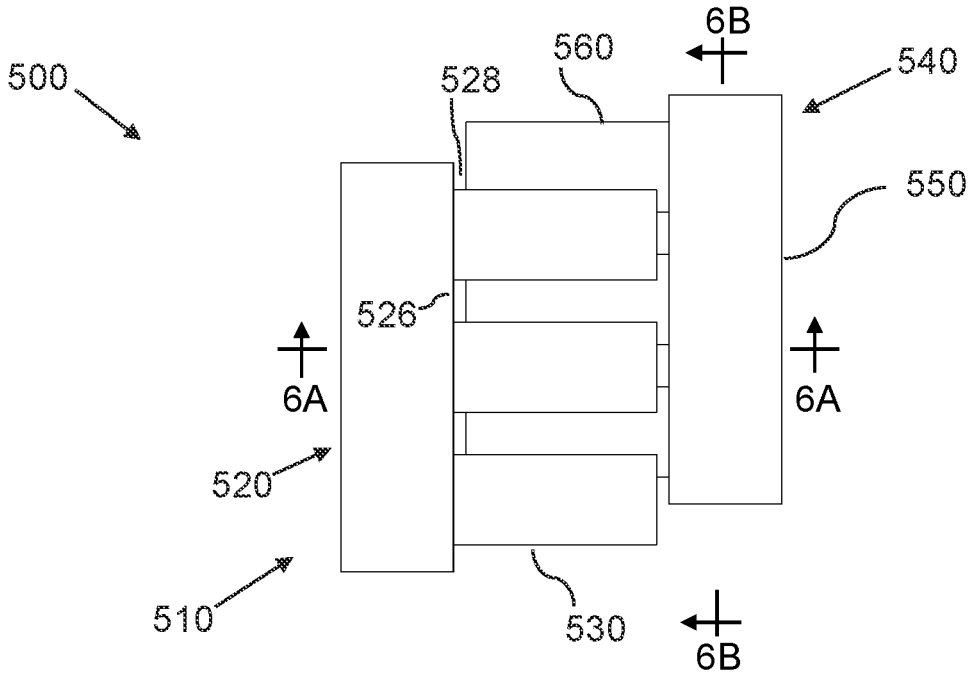
FIG. 5B is a top view of a firework packaging assembly of a firework packaging system, according to an embodiment of the invention.
Figure 5C:
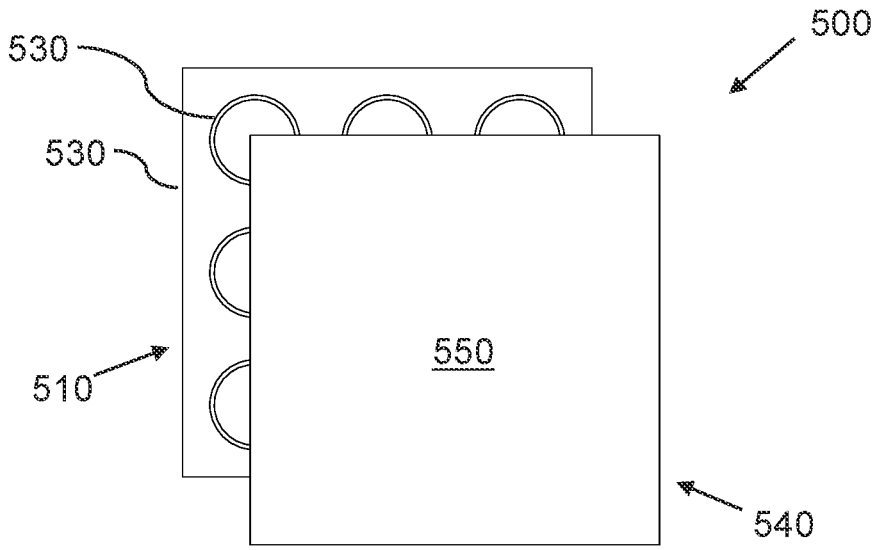
FIG. 5C is a right side view of a firework packaging assembly of a firework packaging system, according to an embodiment of the invention.
Figure 5D:
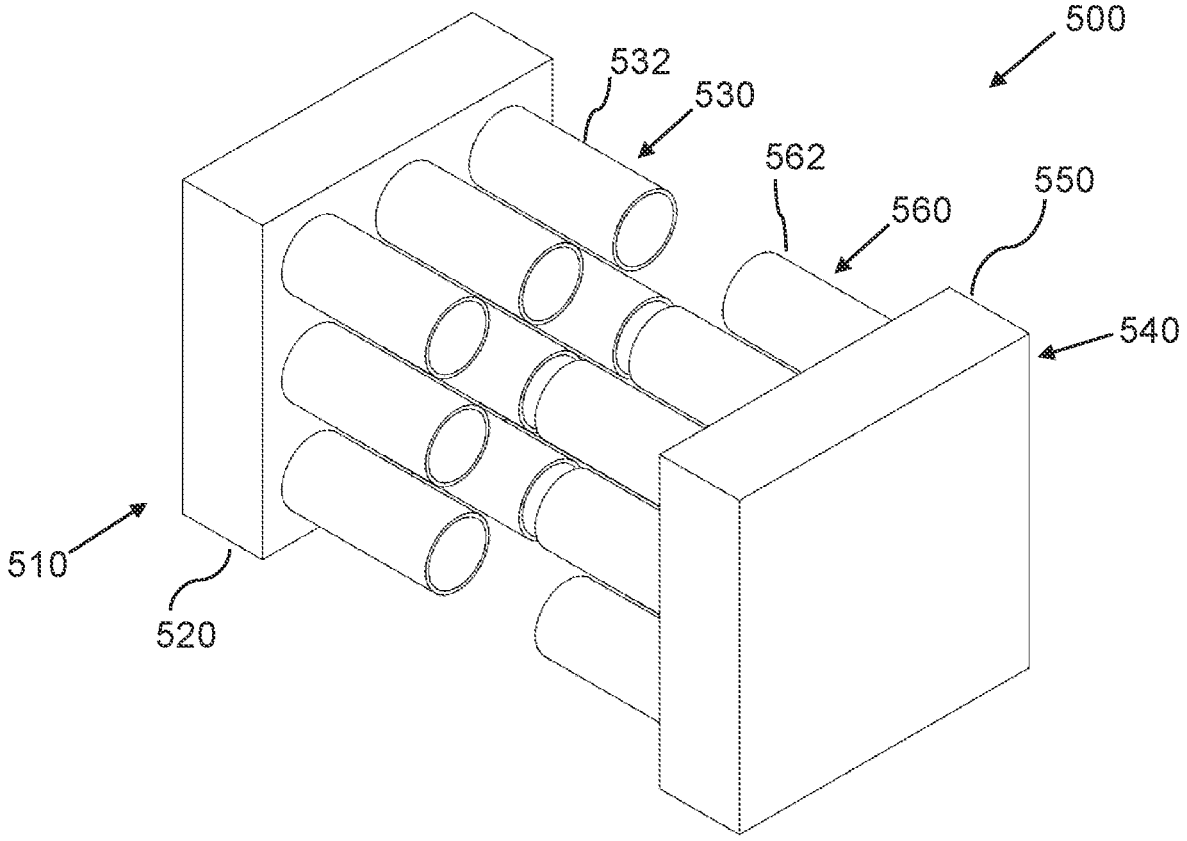
FIG. 5D is a perspective view of a firework packaging assembly of a firework packaging system, shown in a disassembled configuration, according to an embodiment of the invention.
Figure 5E:
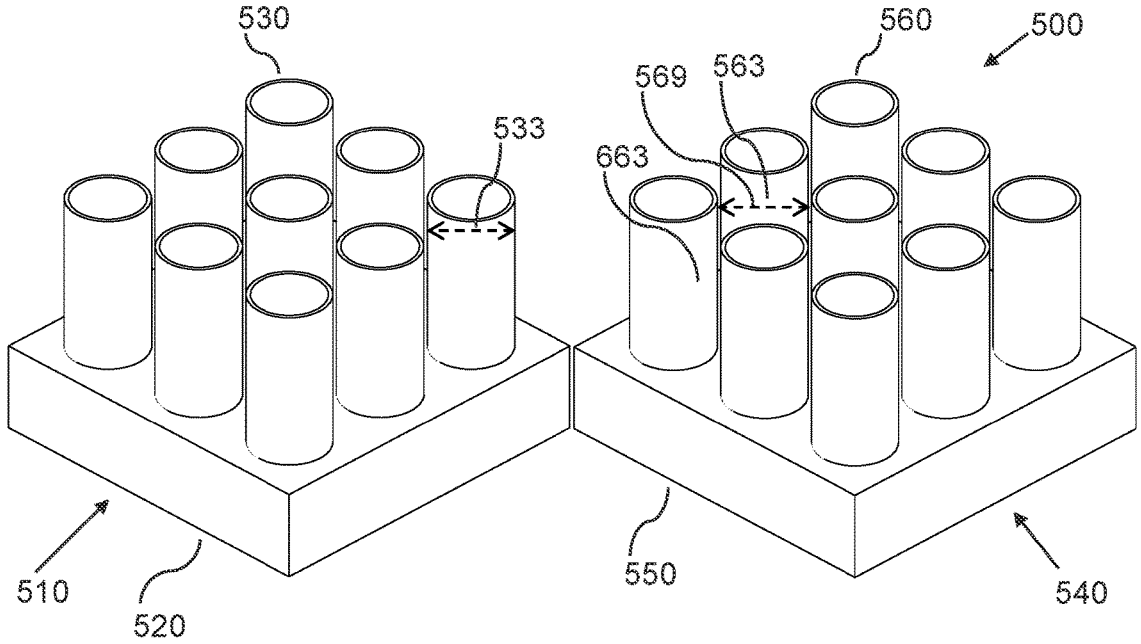
FIG. 5E is a perspective view of a firework packaging assembly of a firework packaging system, shown in a disassembled configuration, according to an embodiment of the invention.
Figure 5F:
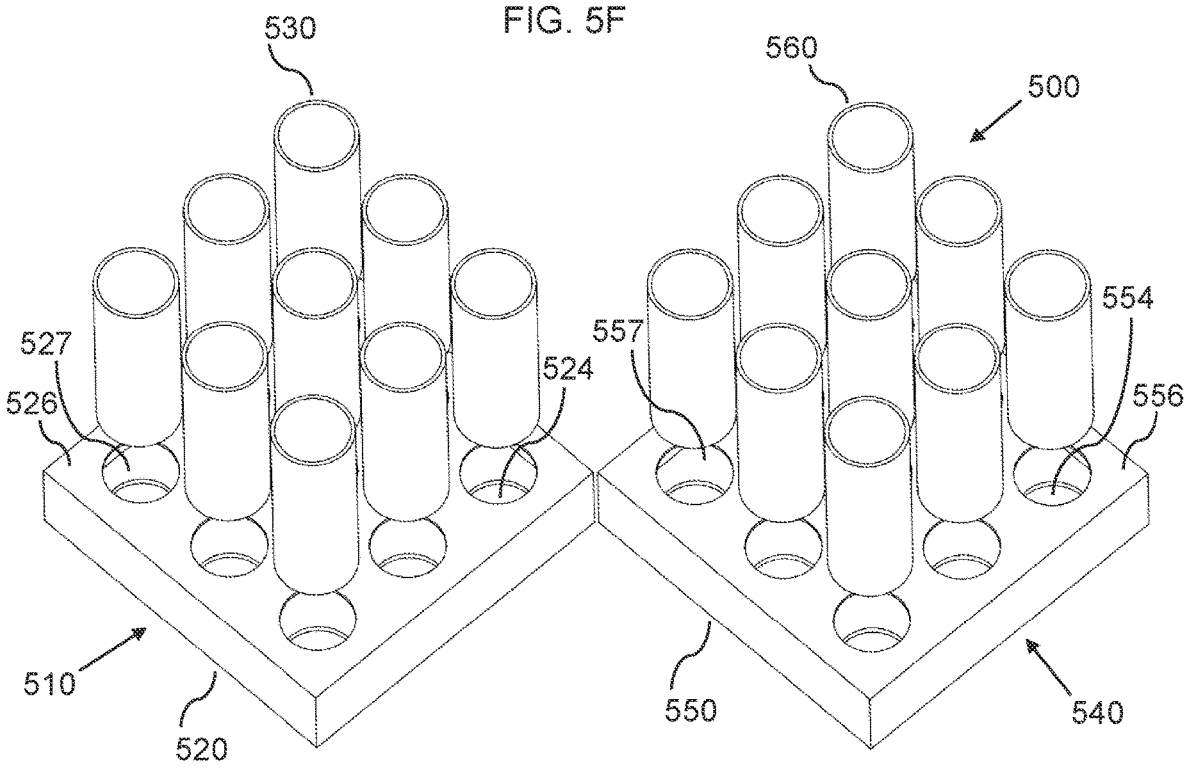
FIG. 5F is a perspective view of a firework packaging assembly of a firework packaging system, shown in a disassembled configuration with launching tubes detached, according to an embodiment of the invention.
Figure 6A:
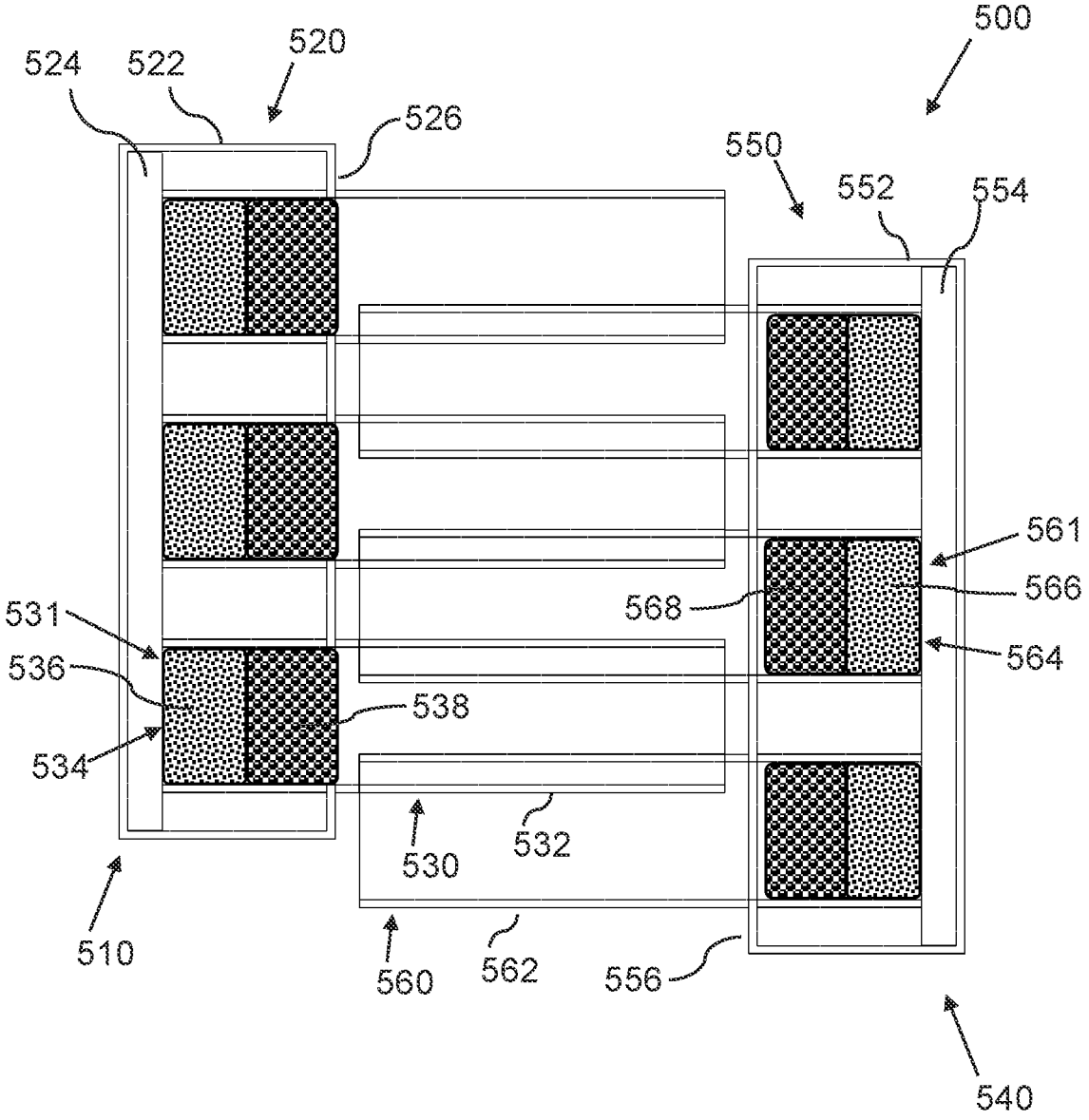
FIG. 6A is a cross-sectional view of the firework packaging assembly, taken along section line 6A-6A of FIG. 5B, according to an embodiment of the invention.
Figure 6B:
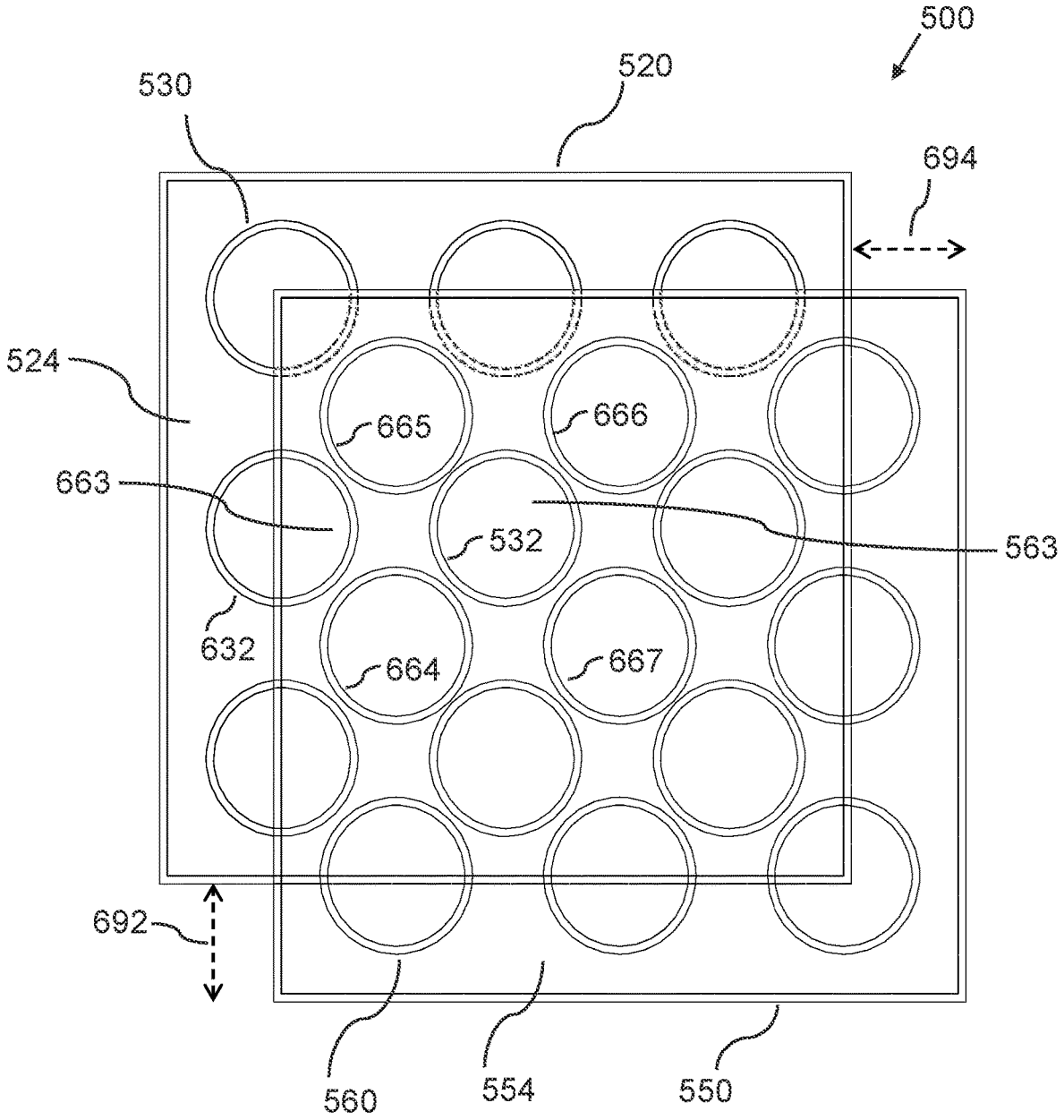
FIG. 6B is a cross-sectional view of the firework packaging assembly, taken along section line 6B-6B of FIG. 5B, according to an embodiment of the invention.

In a related embodiment, as shown in FIGS. 5A-5E and 6A-6B, an outer portion of each corresponding first tube body 532 of the first firework assembly 510 can be configured to be insertable (i.e., slide into) into a corresponding opening 563, 663 along adjacent second tube bodies 562, 664, 665, 666, 667 of the second firework assembly 540, such that the outer portion of the corresponding first tube body 532 can slide between adjacent second tube bodies 562, 664, 665, 666, 667 of the second firework assembly 540, or such that the outer portion of the corresponding first tube body 632 can slide into a corresponding opening 663 to a side of adjacent second tube bodies 664, 665 of the second firework assembly 540, as shown in FIG. 6B; wherein an outer diameter 533 of the outer portion of the corresponding first tube body 532 is configured to match the corresponding opening 563 between adjacent second tube bodies 562, i.e. such that the outer diameter 533 of the outer portion of the corresponding first tube body 532 is slightly smaller than a diameter 569 of the corresponding opening 563;

such that the first firework assembly 510 and the second firework assembly 540 can be configured to be packaged in an opposing externally overlapping configuration, wherein an outer portion of each corresponding first tube body 532 is inserted along adjacent corresponding second tube bodies 562, 664, 665, 666, 667, i.e., such that the first firework assembly 510 and the second firework assembly 540 are opposing/oppositely/opposedly assembled, such that respective first and second base units 520, 550 are on outer sides with respective first and second launching tubes 530, 560 pointing toward each other.

Figure 6C:
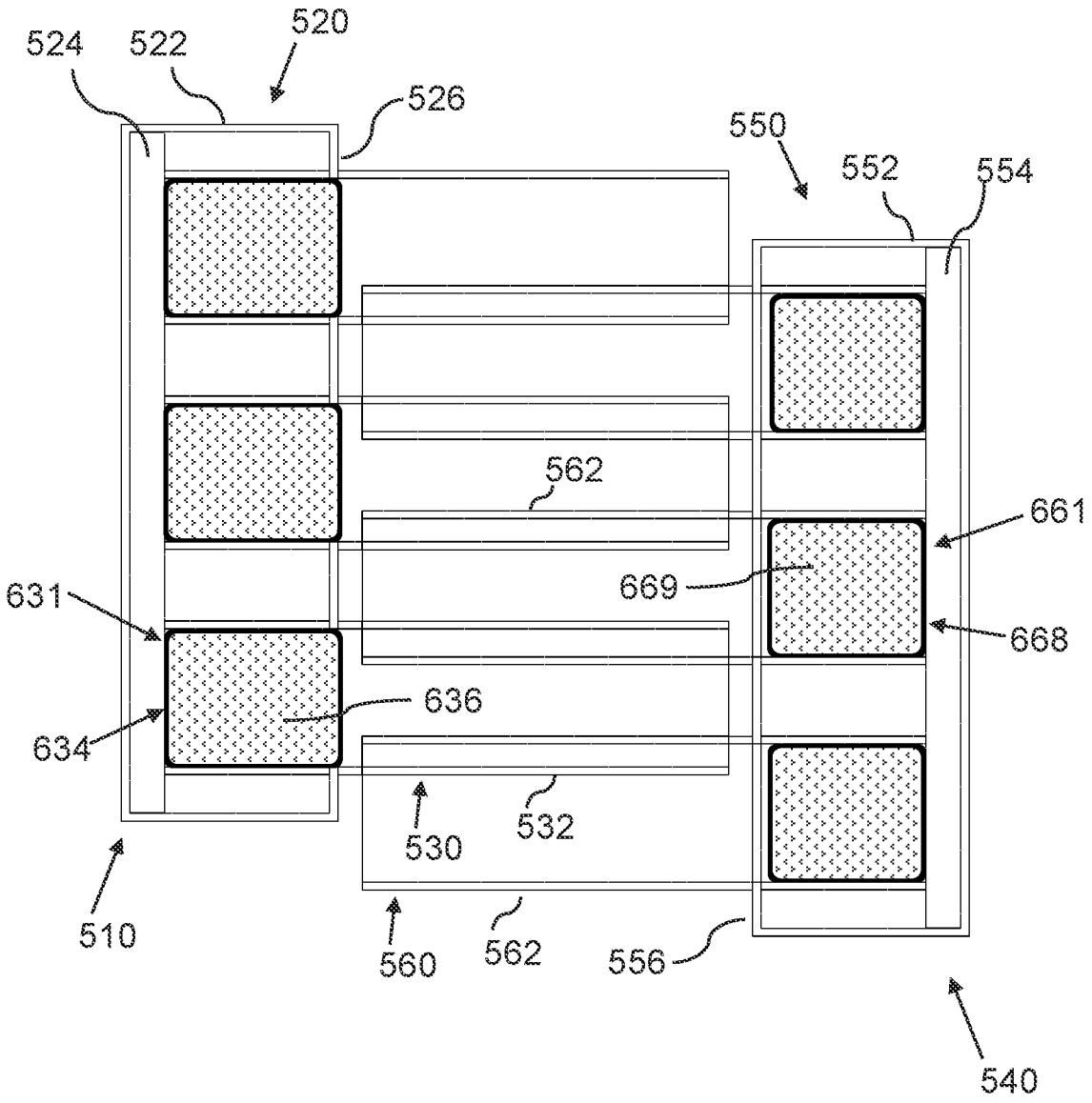
FIG. 6C is a cross-sectional view of the firework packaging assembly, taken along section line 6A-6A of FIG. 5B, according to an embodiment of the invention.

In a related embodiment, as shown in FIG. 6C:

a) the first combustion member 631 can be configured as a first firework mine 634, which is mounted in a bottom of the first tube body 532, wherein the first firework mine 634 can include a composition 636 of a first lift charge and a first effect charge;
   such that the first lift charge is configured to expel the first combustion member 631 from the first launching tube, when the first combustion member 631 is ignited; and b) the second combustion member 661 can be configured as a second firework mine 668, which is mounted in a bottom of the second tube body 562, wherein the second firework mine 668 can include a composition 669 of a second lift charge and a second effect charge;
   such that the second lift charge is configured to expel the second firework mine 668 from the second launching tube, when the second firework mine 668 is ignited.

In a further related embodiment, each of the first firework assembly 510 and the second firework assembly 540 can be configured with nine launching tubes 530, 560, which can be arranged in three rows and three columns, such that the first firework assembly 510 is vertically offset 692 and horizontally offset 694 from the second firework assembly 540, as shown in FIG. 6B. Alternatively each of the first firework assembly 510 and the second firework assembly 540 can be configured with a larger plurality of launching tubes 530, 560, such as 16-100 or more launching tubes 130, 160.

In some related embodiments, there can be a different (i.e., smaller or larger) number of first launching tubes 530 in the first firework assembly 510 than a number of second launching tubes 560 in the second firework assembly 540. For example, the first firework assembly 510 can be configured with four launching tubes 530, and the second firework assembly 540 can be configured with nine second launching tubes 560, such that outer portions (of tube bodies 532) of each first launching tube 530 slide along and between corresponding adjacent second launching tubes 560 (i.e., not to a side for any first launching tube 530, since there is no vertical or lateral offset 692, 694 in this configuration).

In another related embodiment, as shown in FIG. SF, upper surfaces of the first base unit 520 and the second base unit 550, can each include receiving apertures 527, 557, which protrude the base header board 526, 556, such that the base bottom board 524, 554 form a bottom of each receiving aperture 527, 557, such that the launching tubes 530, 560 are detachably positionable in the receiving apertures 527, 557.

Figure 5G:
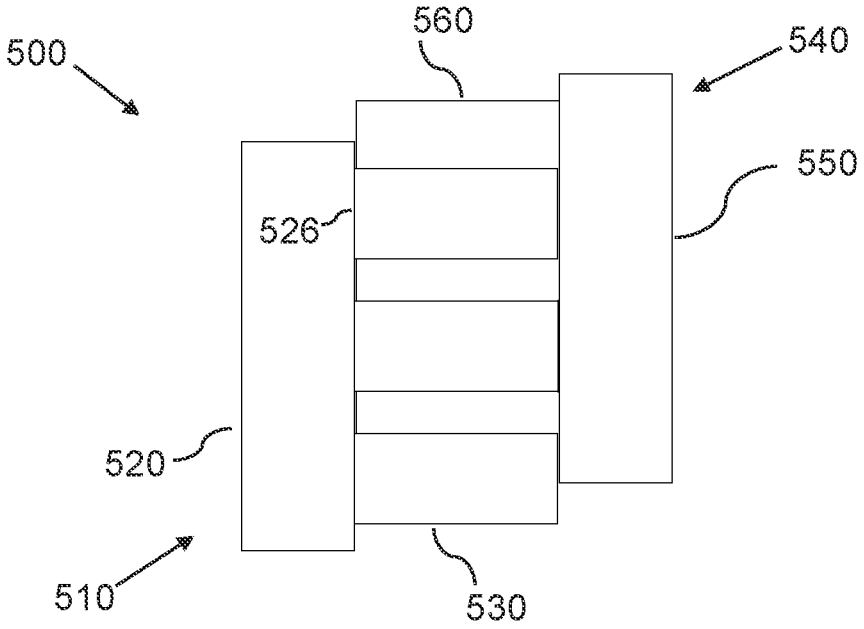
FIG. 5G is a top view of a firework packaging assembly of a firework packaging system, according to an embodiment of the invention.

In related embodiments, as shown in FIGS. 5B and 5G, the firework packaging assembly 500 can be configured with a variable gap 528 between outer ends of second launching tubes 560 and the base header board 526 of the first base unit 520, depending on how far first launching tubes 530 are slid in between corresponding adjacent second launching tubes 560. FIG. 5G shows a configuration wherein the first launching tubes 530 are maximally inserted, such that outer ends of second launching tubes 560 touch or almost touch the base header board 526, such that the variable gap 528 is substantially zero.

Figure 7:
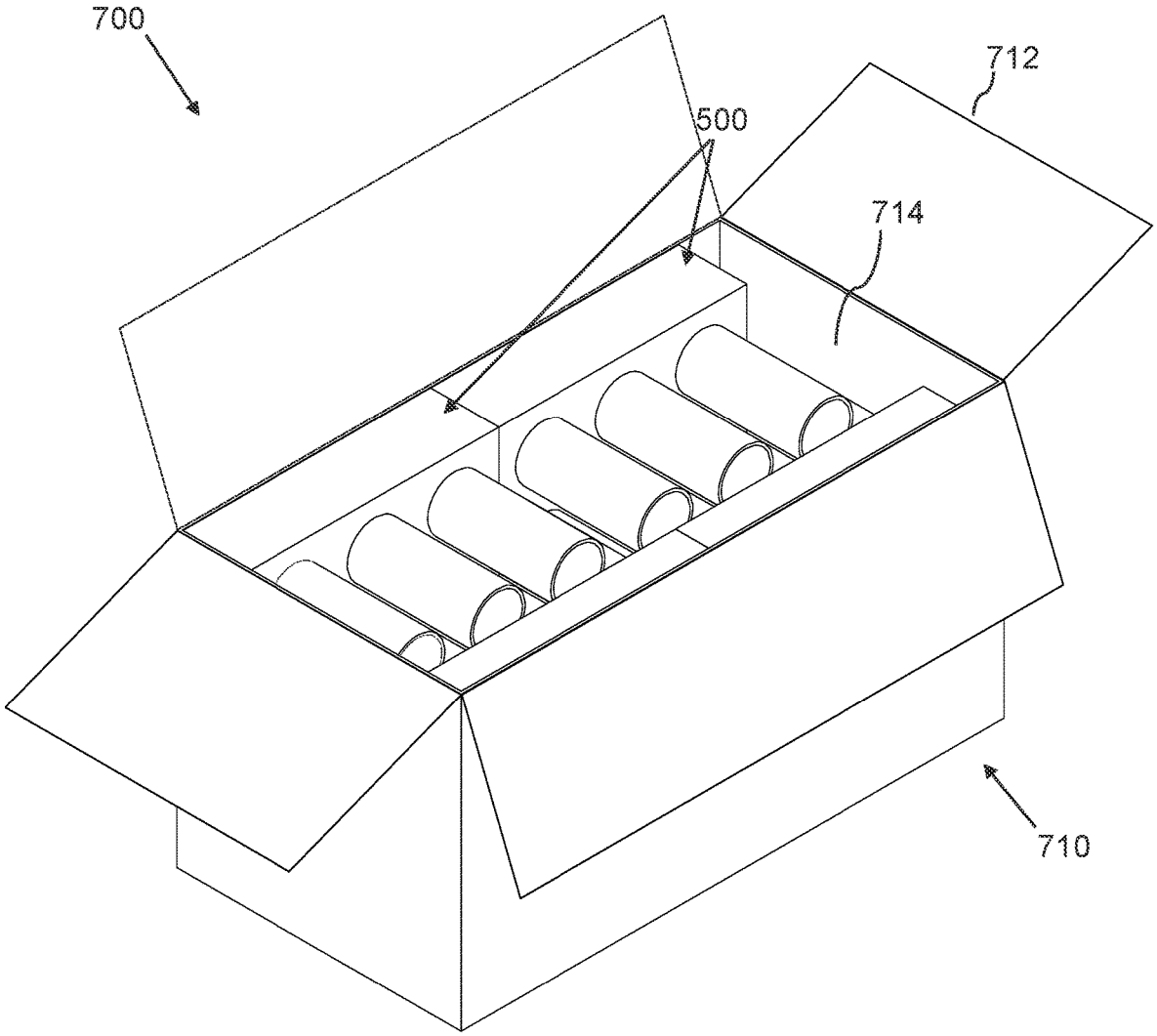
FIG. 7 is a perspective view of a firework packaging system, including two packaged firework packaging assemblies, according to an embodiment of the invention.

In a related embodiment, as shown in FIG. 7, a firework packaging system 700 can include:

a) firework case 710, which can include:
   i. a packaging case 712, which includes a packaging interior 714; and
   ii. a plurality of firework packaging assemblies 500, which are positioned in the packaging interior 714 of the packaging case 712.

In a further related embodiment, as shown in FIG. 7, the firework packaging system 700 can include two firework packaging assemblies 500.

Figure 8:
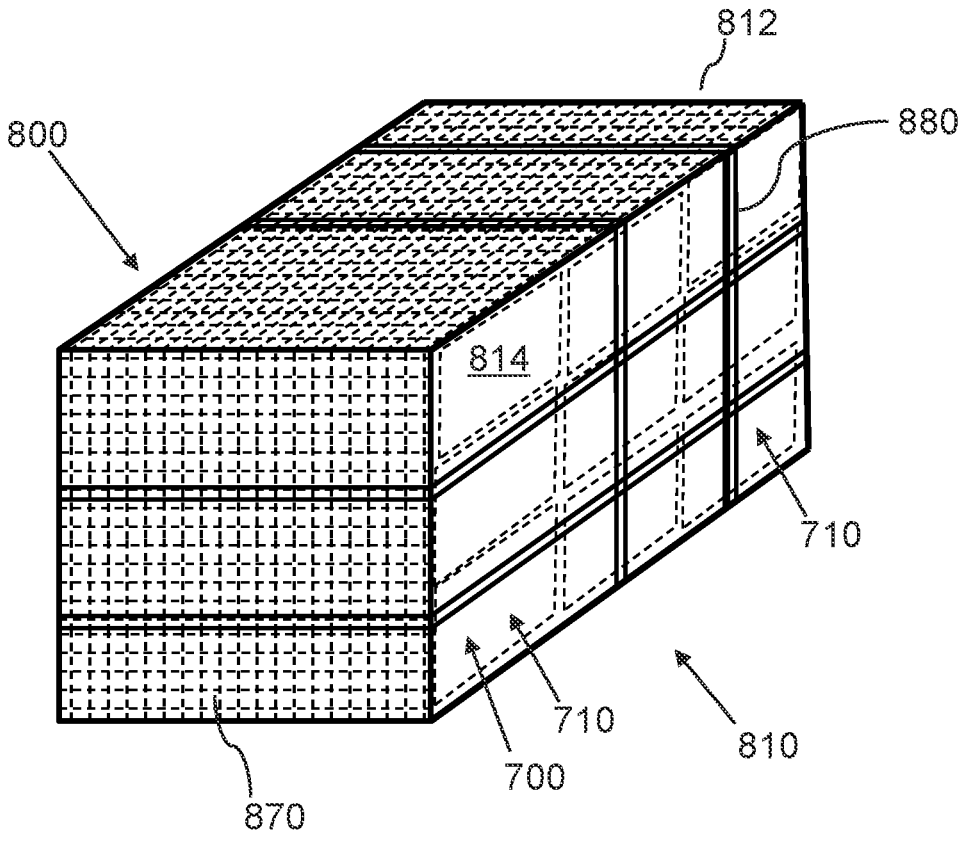
FIG. 8 is a perspective view of a firework packaging system, according to an embodiment of the invention.

In a related embodiment, as shown in FIG. 8, a firework packaging system 800 can include:

a) a firework crate 810, which can include:
   i. a shipping crate 812, which includes a crate interior 814; and
   ii. a plurality of firework cases 710 (with firework packaging assemblies 500 inside), which are positioned in the crate interior 814 of the shipping crate 812.

In a further related embodiment, as shown in FIG. 8, the firework packaging system 800, can further include:

a) a protective mesh 870, which can be made of metal, wherein the protective mesh 870 can be positioned on an outer surface of the shipping crate 812, such as for example on front, rear, top, and bottom of the shipping crate 812, or on all sides of the shipping crate 810; and b) a plurality of packing bands 880, which can be metal bands 880, wherein the packing bands 880 can be tightened around (vertically or horizontally) the shipping crate 812, for example at least partially on top of the protective mesh 870.

In related embodiments, the tube bodies 132, 162, 532, 562 can be made from paper, glass fiber, carbon fiber, composite fiber materials, high-density polyethylene, steel, and combinations thereof.

Thus, in various related embodiments, the firework packaging assembly 100 can be used for arial fireworks that requires a launching tube or launching tubes. A shell 134, 164 is the fireworks part which produces the desired effect in the air. A shell typically includes a lift charge 136 and an effect charge 138. While in operation, the lift charge is first ignited to release large amounts of gas and propel the effect charge into the sky, whereupon the effect charge is then ignited and produces visual and audio effects. The 9 units can share the same base bottom board 154, which provides the following functions: 1) the bottom side of the launching tube, which reacts with the launching tube to provide a confined space to allow the lift charge to propel the fireworks into the air. 2) The nine units can also share the same base heading, which functions as a reinforcement to the overall tube and base bottom board structure to ensure the integrity of the fireworks unit's structure during shipping and handling. The base bottom board can be made of wood or plastic.

In other related embodiments, for transportation safety, fireworks devices must be securely packaged in protective containers complying with appropriate regulations. The protective container is typically made from a paper cardboard box. A protective container may contain multiple fireworks devices. As per current practices, multiple fireworks are placed into the container individually without overlapping with each other. The firework packaging assembly 100 differentiates from current practices by introducing methods to allow fireworks devices packaged inside the same container to be overlapped with other devices in order to conserve the shipping volume.

In related embodiments, FIG. 1A shows the firework packaging assembly 100 configured to use internal overlapping, such that fireworks devices are packaged in pairs. In each pair, the launching tube diameter of one device is slightly smaller than that of the other device. When the two devices in a pair are put together, a portion of the smaller tubes can be inserted inside the large tubes. The height of the base will control how much overlapping, to ensure the small tube will not touch the fireworks charge inside the large tube. Each container can include one pair or multiple pairs of fireworks devices. FIG. 3 shows an example of putting two firework packaging assemblies 100 in a case 310.

In related embodiments, FIG. 5A shows the firework packaging assembly 500 configured to use external overlapping. Fireworks safety regulations, such as the APA standard (ref 1), requires that tubes must be separated from each other so that the firing tube will not cause a misfiring of the adjacent ones. This invention proposes to insert the launching tubes of one device into the space between tubes in the other unit in that pair.

In a related embodiment, the internal overlapping packaging method can be applied to a firework packaging assembly 100 containing two opposing and internally overlapping launching tubes only, with one tube partially inserted inside the other tube, during transport or storage.

In various related embodiments, other modifications in fireworks manufacturing and testing processes must be altered in order to utilize the proposed packaging methods. The allowable tolerance for tube placement position and the angle in the internal method will be much lower than prior "non overlapping" packaging methods. Fireworks devices with current packaging methods are in an upright position (same as the final operation position) and the charge does not have the tendency to separate from the base end during shipping. However, with the firework packaging assembly 100, 500, the fireworks devices can be placed in a sideways position (90 degrees to the final operation position) or even an upside-down position, as longs as the firework shell 134 are securely mounted inside the launching tubes 130, for example using strong adhesive.

In other related embodiments, the firework packaging assembly 100, 500 also improves shipping safety. An important safety standard is the measurement of fireworks projectiles under external fires as specified in the series 6 of the UN Recommendations on the transport of dangerous goods, manual of tests and criteria. When using the firework packaging assembly 100, 500, the opposing base bottom board of a pair of opposedly mounted launching tubes can potentially provide additional confinement to the shell, compared to a typical open end package configuration. The internal overlapping configuration provides particularly advantageous improvements since all shells will be completely confined by the base bottom board from the paring unit.

Thus, the various embodiments of the firework packaging assembly 100, 500 and the related firework packaging systems 300, 400, 700, 800 provide a packing configuration which reduces shipping costs and improves safety.

Here has thus been described a multitude of embodiments of the firework packaging assembly 100, 500, the firework packaging systems 300, 400, 700, 800, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A firework packaging system, comprising:
a firework packaging assembly, comprising:
a first firework assembly, comprising:
a first base unit; and
at least one first launching tube, comprising:
a first tube body;
wherein an inner portion of the at least one first launching tube is mounted in the first base unit; and
a second firework assembly, comprising:
a second base unit; and
at least one second launching tube, comprising:
a second tube body;
wherein an inner portion of the at least one second launching tube is mounted in the second base unit;
wherein the first firework assembly and the second firework assembly are configured to be packaged in an opposing internally overlapping configuration, such that an outer portion of each corresponding first tube body of the first firework assembly is configured to be insertable into a corresponding second tube body of the second firework assembly.

2. The firework packaging system of claim 1, wherein:
a) the first base unit further comprises:
a first base body;
a first base bottom board, which is mounted on a bottom of the first base body; and
a first base header board, which is mounted on a top of the first base body; and
b) the second base unit further comprises:
a second base body;
a second base bottom board, which is mounted on a bottom of the second base body; and
a second base header board, which is mounted on a top of the second base body.

3. The firework packaging system of claim 1, wherein:
a) the at least one first launching tube further comprises:
a first firework shell, which is mounted in a bottom of the first tube body, wherein the first firework shell comprises:
a first lift charge; and a first effect charge, which is positioned on an outer side of the first lift charge;

such that the first lift charge is configured to expel the first effect charge from the first tube body, when the first lift charge is ignited; and b) the at least one second launching tube further comprises:

a second firework shell, which is mounted in a bottom of the second tube body, wherein the second firework shell comprises:

a second lift charge; and a second effect charge, which is positioned on an outer side of the second lift charge;

such that the second lift charge is configured to expel the second effect charge from the second tube body, when the second lift charge is ignited.

4. The firework packaging system of claim 1, wherein:

a) the at least one first launching tube further comprises:

a first firework mine, which is mounted in a bottom of the first tube body, wherein the first firework mine comprises a composition of:

a first lift charge; and a first effect charge;

such that the first lift charge is configured to expel the first firework mine from the first tube body, when the first firework mine is ignited; and b) the at least one second launching tube further comprises:

a second firework mine, which is mounted in a bottom of the second tube body, wherein the second firework mine comprises:

a second lift charge; and a second effect charge;

such that the second lift charge is configured to expel the second firework mine from the second tube body, when the second firework mine is ignited.

5. The firework packaging system of claim 1, further comprising:

a firework case, comprising:

a packaging case, which comprises a packaging interior; and a plurality of firework packaging assemblies, which are positioned in the packaging interior of the packaging case, wherein the plurality of firework packaging assemblies comprises the firework packaging assembly.

6. The firework packaging system of claim 5, wherein the firework case comprises two firework packaging assemblies.

7. The firework packaging system of claim 5, further comprising:

a firework crate, comprising:

a shipping crate, which comprises a crate interior; and a plurality of firework cases, which are positioned in the crate interior of the shipping crate, wherein the plurality of firework cases comprises the firework case.

8. The firework packaging system of claim 7, wherein the firework crate further comprises:

a) a protective mesh, which is positioned on an outer surface of the shipping crate; and b) a plurality of packing bands, which are tightened around the outer surface of the shipping crate.

9. The firework packaging system of claim 8, wherein the packing bands are at least partially on top of the protective mesh.

10. The firework packaging system of claim 1, wherein each of the first firework assembly and the second firework assembly are configured with nine launching tubes, which are arranged in three rows and three columns.

11. A firework packaging system, comprising:

a firework packaging assembly, comprising:

a first firework assembly, comprising:

a first base unit; and a plurality of first launching tubes, each comprising:

a first tube body;

wherein an inner portion of each first launching tube is mounted in the first base unit;

a second firework assembly, comprising:

a second base unit; and a plurality of second launching tubes, each comprising:

a second tube body;

wherein an inner portion of each second launching tube is mounted in the second base unit;

wherein the first firework assembly and the second firework assembly are configured to be packaged in an opposing externally overlapping configuration, such that an outer portion of each corresponding first tube body of the first firework assembly is configured to be insertable into a corresponding opening along adjacent second tube bodies of the second firework assembly.

12. The firework packaging system of claim 11, wherein:

a) the first base unit further comprises:

a first base body;

a first base bottom board, which is mounted on a bottom of the first base body; and a first base header board, which is mounted on a top of the first base body; and b) the second base unit further comprises:

a second base body;

a second base bottom board, which is mounted on a bottom of the second base body; and a second base header board, which is mounted on a top of the second base body.

13. The firework packaging system of claim 11, wherein:

a) each first launching tube further comprises:

a first firework shell, which is mounted in a bottom of the first tube body, wherein the first firework shell comprises:

a first lift charge; and a first effect charge, which is positioned on an outer side of the first lift charge;

such that the first lift charge is configured to expel the first effect charge from the first tube body, when the first lift charge is ignited; and b) each second launching tube further comprises:

a second firework shell, which is mounted in a bottom of the second tube body, wherein the second firework shell comprises:

a second lift charge; and a second effect charge, which is positioned on an outer side of the second lift charge;

such that the second lift charge is configured to expel the second effect charge from the second tube body, when the second lift charge is ignited.

14. The firework packaging system of claim 11, further comprising:

a firework case, comprising:

a packaging case, which comprises a packaging interior; and a plurality of firework packaging assemblies, which are positioned in the packaging interior of the packaging case, wherein the plurality of firework packaging assemblies comprises the firework packaging assembly.

15. The firework packaging system of claim 14, wherein the firework case comprises two firework packaging assemblies.

16. The firework packaging system of claim 14, further comprising:

a firework crate, comprising:

a shipping crate, which comprises a crate interior; and a plurality of firework cases, which are positioned in the crate interior of the shipping crate, wherein the plurality of firework cases comprises the firework case.

17. The firework packaging system of claim 16, wherein the firework crate further comprises:

a) a protective mesh, which is positioned on an outer surface of the shipping crate; and b) a plurality of packing bands, which are tightened around the outer surface of the shipping crate.

18. The firework packaging system of claim 17, wherein the packing bands are at least partially on top of the protective mesh.

19. The firework packaging system of claim 11, wherein each of the first firework assembly and the second firework assembly are configured with nine launching tubes, which are arranged in three rows and three columns, such that the first firework assembly is vertically offset and horizontally offset from the second firework assembly.

20. A firework packaging system, comprising:

a firework packaging assembly, comprising:

a first firework assembly, comprising:

a first base unit; and a plurality of first launching tubes, each comprising:

a first tube body;

wherein an inner portion of each first launching tube is mounted in the first base unit; and a second firework assembly, comprising:

a second base unit; and a plurality of second launching tubes, each comprising:

a second tube body;

wherein an inner portion of each second launching tube is mounted in the second base unit;

wherein the first firework assembly and the second firework assembly are configured to be packaged in an opposing overlapping configuration.

21. The firework packaging system of claim 20, wherein the opposing overlapping configuration is an opposing internally overlapping configuration, such that an outer portion of each corresponding first tube body of the first firework assembly is configured to be insertable into a corresponding second tube body of the second firework assembly.

22. The firework packaging system of claim 20, wherein the opposing overlapping configuration is an opposing externally overlapping configuration, such that an outer portion of each corresponding first tube body of the first firework assembly is configured to be insertable into a corresponding opening along adjacent second tube bodies of the second firework assembly.

23. The firework packaging system of claim 20, wherein:

a) each first launching tube further comprises:

a first firework shell, which is mounted in a bottom of the first tube body, wherein the first firework shell comprises:

a first lift charge; and a first effect charge, which is positioned on an outer side of the first lift charge;

such that the first lift charge is configured to expel the first effect charge from the first tube body, when the first lift charge is ignited; and b) each second launching tube further comprises:

a second firework shell, which is mounted in a bottom of the second tube body, wherein the second firework shell comprises:

a second lift charge; and a second effect charge, which is positioned on an outer side of the second lift charge;

such that the second lift charge is configured to expel the second effect charge from the second tube body, when the second lift charge is ignited.

24. The firework packaging system of claim 20, further comprising:

a firework case, comprising:

a packaging case, which comprises a packaging interior; and a plurality of firework packaging assemblies, which are positioned in the packaging interior of the packaging case, wherein the plurality of firework packaging assemblies comprises the firework packaging assembly.

25. The firework packaging system of claim 24, wherein the firework case comprises two firework packaging assemblies.

26. The firework packaging system of claim 24, further comprising:

a firework crate, comprising:

a shipping crate, which comprises a crate interior; and a plurality of firework cases, which are positioned in the crate interior of the shipping crate, wherein the plurality of firework cases comprises the firework case.

27. The firework packaging system of claim 26, wherein the firework crate further comprises:

a) a protective mesh, which is positioned on an outer surface of the shipping crate; and b) a plurality of packing bands, which are tightened around the outer surface of the shipping crate.

* * * * *